US006349550B1

(12) United States Patent
Shapiro et al.

(10) Patent No.: US 6,349,550 B1
(45) Date of Patent: Feb. 26, 2002

(54) ICE TRANSFORMATION DETECTION

(75) Inventors: Andrew Philip Shapiro; Jerome Johnson Tiemann, both of Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,910

(22) Filed: Jun. 25, 2001

(51) Int. Cl.[7] ..... F25C 1/12

(52) U.S. Cl. ..... 62/72; 62/233

(58) Field of Search ..... 62/72, 135, 233, 62/155, 156

(56) References Cited

U.S. PATENT DOCUMENTS 3,449,919 A * 6/1969 Fox ..... 62/233
4,646,529 A * 3/1987 Hanson ..... 62/155
4,882,908 A * 11/1989 White ..... 62/155
6,092,374 A * 7/2000 Kang et al. ..... 62/233

* cited by examiner

*Primary Examiner*—William E. Tapolcai
(74) *Attorney, Agent, or Firm*—Patrick K. Patnode; Christian G. Cabou

(57) ABSTRACT

An ice tray is filled with water and exposed to freezing temperature in a freezer. The freezing temperature is measured and integrated over time to obtain a monitoring parameter. The parameter is compared with a predetermined freezing standard for detecting transformation of the water into ice.

18 Claims, 2 Drawing Sheets

ICE TRANSFORMATION DETECTION

BACKGROUND OF INVENTION

The present invention relates generally to refrigerators, and, more specifically, to ice making therein.

Residential refrigerators commonly include a refrigeration compartment for storing food products above freezing temperature, and a freezer compartment for storing food items below freezing temperature. The freezer commonly includes an automatic icemaker for producing ice cubes which are stored in a hopper or bin for periodic use as desired.

Since ice is made in batches from a multi-compartment ice tray, detection of water-to-ice transformation is required for dumping a batch of ice cubes prior to refilling the ice tray with water for the next batch. Ice detection is typically accomplished by using a dedicated temperature sensor mounted directly in the ice tray for detecting the reduction in water temperature to below freezing temperatures upon transformation to ice.

Another temperature sensor is found in the freezer for controlling operation of the refrigeration system which circulates below-freezing temperature air through the freezer.

The refrigerator-freezer therefore requires two temperature sensors for two different purposes, which sensors must be operatively joined in the refrigeration system and automatic icemaker for controlling operation thereof.

Accordingly, it is desired to provide a refrigerator having an improved method and apparatus for detection of ice transformation in the icemaker.

SUMMARY OF INVENTION

An ice tray is filled with water and exposed to freezing temperature in a freezer. The freezing temperature is measured and integrated over time to obtain a monitoring parameter. The parameter is compared with a predetermined freezing standard for detecting transformation of the water into ice.

BRIEF DESCRIPTION OF DRAWINGS

The invention, in accordance with preferred and exemplary embodiments, together with further objects and advantages thereof, is more particularly described in the following detailed description taken in conjunction with the accompanying drawings in which.

DETAILED DESCRIPTION

Figure 1:
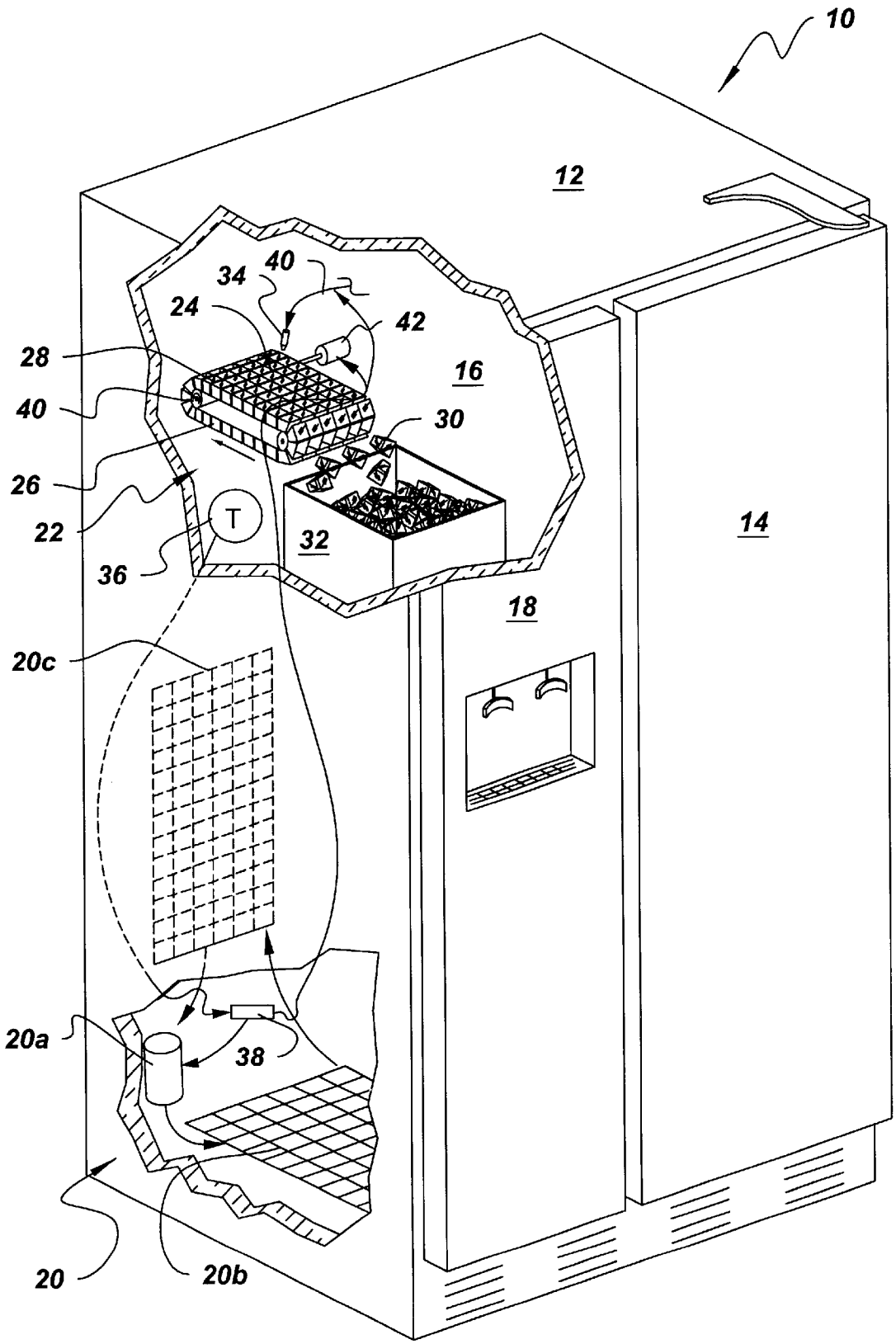
FIG. 1 is a partly sectional isometric view of an exemplary refrigerator-freezer having an automatic icemaker illustrated schematically in accordance with an exemplary embodiment of the present invention.

Illustrated in FIG. 1 is a refrigerator 10 in the exemplary form of a residential side-by-side refrigerator-freezer. The refrigerator includes a refrigeration compartment on the right side accessible behind a right refrigerator door 14, and a freezer compartment 16 on the left side behind a freezer door 18.

The refrigerator has a refrigeration system 20 of any conventional form for removing heat from inside the refrigerator and freezer compartments. For example, the refrigeration system 20 typically includes a compressor 20*a* in which a suitable refrigerant is compressed, an external condenser 20*b* through which the refrigerant is channeled for removing heat therefrom, and an evaporator 20*c* suitably mounted inside the freezer for extracting heat therefrom.

The compressor, condenser, and evaporator are operatively joined together in a closed fluid loop through which the refrigerant is circulated during operation. A fan (not shown) is typically mounted inside the freezer for circulating air through both the freezer and refrigeration compartments. The temperature of the circulating air is reduced as it passes over the evaporator in a conventional manner for maintaining above-freezing temperatures in the refrigeration compartment, and below-freezing temperatures in the freezer compartment during operation.

Disposed in the freezer compartment illustrated in FIG. 1 is an automatic icemaker 22 which may have any suitable form. For example, the icemaker includes an ice tray 24 having rows of ice molds or compartments 26 in which water 28 is held until freezing into ice cubes 30 which are automatically dumped or ejected from the tray into a storage hopper or bin 32 suitably mounted inside the freezer door.

Means in the exemplary form of a water nozzle 34 are suitably mounted in the freezer and joined to a source of water for periodically filling the ice tray as required to produce the ice cubes. The water nozzle is typically joined to an electrical solenoid valve (not shown) which may be activated in a conventional manner for periodically discharging water from the nozzle as required.

The icemaker illustrated in FIG. 1 operates in conjunction with the refrigeration system 20 for exposing the water in the ice tray to below-freezing temperatures inside the freezer compartment. This is effected by circulating air inside the freezer at below-freezing temperature by operation of the evaporator 20*c*.

During operation, the water nozzle 34 is used for filling the ice tray 24 with water which will then freeze therein after a sufficient amount of time inside the below-freezing environment provided in the freezer. The freezing time of the water is dependent on many variables including the initial temperature of the water itself and the temperature inside the freezer. In conventional icemakers, the transformation of the water to ice and its readiness for discharge into the hopper is typically determined by the direct measurement of water temperature in an individual ice mold for determining whether a suitable below-freezing temperature has been achieved.

However, instead of using direct temperature measurement of the water in the ice tray, an indirect method of measuring the water temperature inside the ice tray is used in accordance with the present invention for several advantages.

More specifically, a temperature sensor 36 is suitably mounted inside the freezer compartment illustrated in FIG. 1, preferably in the vicinity of the ice tray 24. The sensor may have any conventional configuration, such as a thermistor, which provides an electrical signal output indicative of the measured temperature inside the freezer compartment. In this way, the freezing temperature of the environment surrounding the ice tray may be accurately measured for use in determining readiness of the ice cube production in each batch.

Means in the form of an electrical controller 38 are suitably located inside the refrigerator cabinet, and is operatively joined to the temperature sensor 36. In a preferred embodiment the controller is in the form of a digitally programmable computer or microprocessor which is configured for controlling the various operating elements of the refrigerator including its refrigeration system 20 and the icemaker 22.

In particular, the controller 38 is specifically configured for integrating over time the measured temperature from the temperature sensor 36 commencing with filling of the ice tray with water to obtain a monitoring parameter indicative of the transformation of the water to ice during the freezing process over time. In this way, the amount of time that the water in the ice tray is maintained at below-freezing temperature is measured and recorded until the water is transformed to ice. The monitoring parameter is compared inside the controller with a predetermined freezing standard or criterion for indirectly detecting transformation of the water into ice.

Integration of the measured temperature over time is readily effected in the controller by using a suitable timing clock therein. The temperature inside the freezer compartment is measured by the sensor 36 and periodically integrated or added over time so that the monitoring parameter has a unit measurement of the product of temperature and time. For example, the temperature may be measured once every minute so that the monitoring parameter has a measurement unit of degree-minute.

The freezing standard is preferably a constant value predetermined in any suitable manner such as by testing. Since the freezer compartment is typically maintained in a temperature range of about 5–15 degrees F., the freezing standard is preferably a constant value within the exemplary range of about 1,000–3,500 degree-minutes.

The monitoring parameter is indicative of the time experienced by the water at the measured temperature inside the freezer below freezing for which values greater than the predetermined freezing standard are indicative of transformation of the water into ice in the production of ice cubes in each batch.

In the preferred embodiment illustrated in FIG. 1, the temperature sensor 36 is positioned remote from the ice tray 26 at any suitable location inside the freezer compartment, and preferably near the ice tray if desired. In this way, the temperature sensor need not be mounted directly in the ice tray 24 itself, which is typically removable for periodic cleaning or maintenance as required. A particular advantage of the indirect method of detecting ice transformation in the ice tray is that the freezing temperature inside the freezer compartment may be measured by the temperature sensor at a position remote from the ice tray while still being effective for detecting ice transformation.

Figure 2:
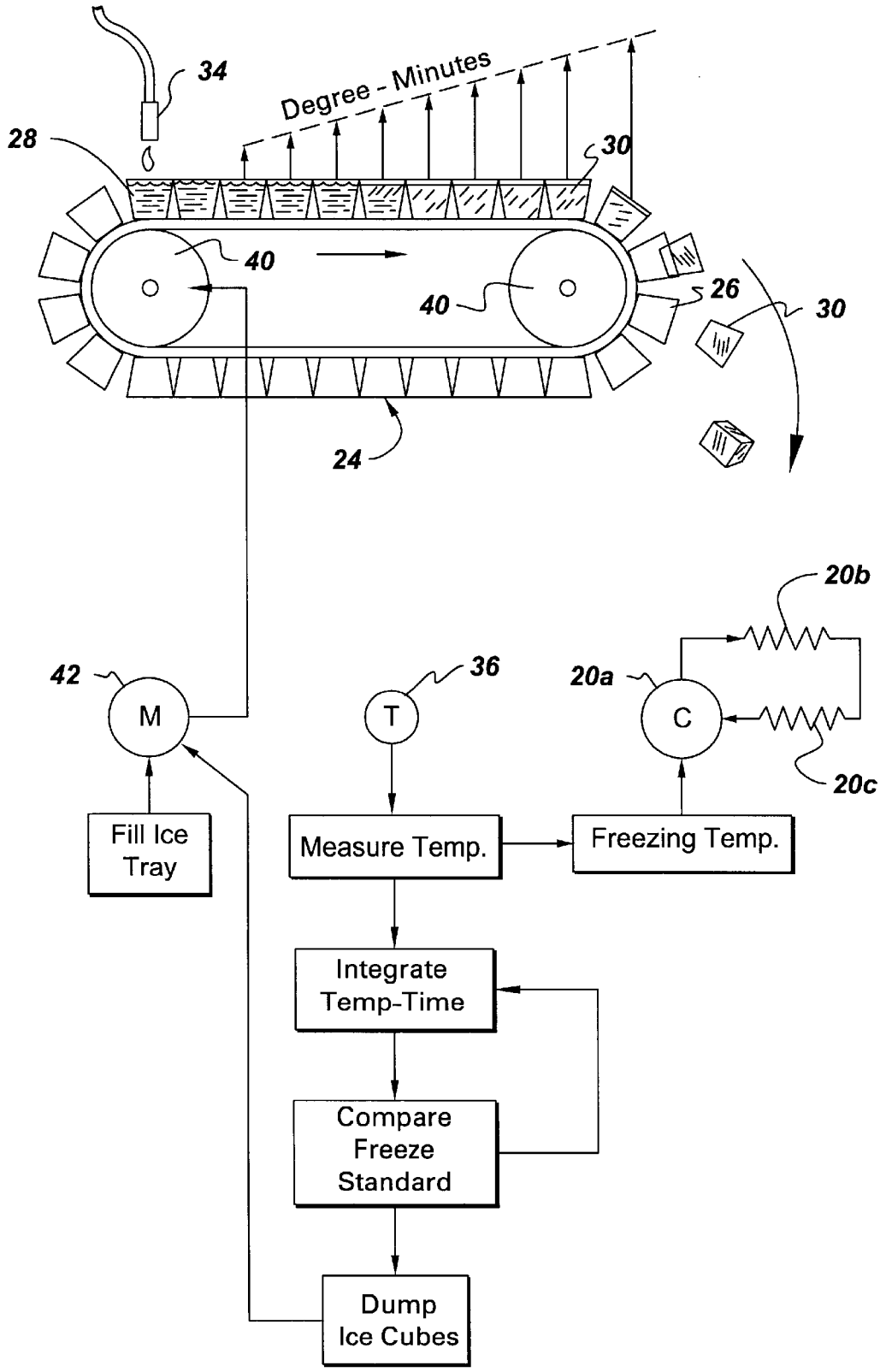
FIG. 2 is a schematic and flowchart representation of the automatic icemaker illustrated in FIG. 1.

FIG. 2 illustrates schematically in flowchart form operation of the automatic icemaker illustrated in FIG. 1. The controller is suitably configured in software for periodically comparing the integrated temperature monitoring parameter with the freezing standard until a match is obtained. Initially, while the water in the ice tray remains liquid, the monitoring parameter will have a relatively low but increasing degree-minute value.

When the water inside the freezer has been exposed to freezing temperature for a sufficient amount of time, the degree-minute units in the monitoring parameter accumulate to a value eventually equaling and exceeding the predetermined freezing standard indicating a match therewith corresponding with suitable transformation of the water into ice cubes. For example, the monitoring parameter may be compared with the freezing standard every minute until a match is obtained, after which the controller may be operated for dumping the batch of ice cubes so formed into the hopper 32 illustrated in FIG. 1.

Although the ice tray 24 illustrated in FIG. 1 may have a conventional form with corresponding forks or tines for automatically dumping the formed ice cubes, the ice tray 24 is preferably in the form of a continuous belt having several rows of the ice molds 26 therein. The belt is formed of a suitable elastomeric material such as silicone rubber, and is suitably mounted on a pair of supporting rollers 40.

One of the rollers may be an idler roller, with the other roller being drive n by a suitable electrical motor 42 operatively joined thereto by a worm gear and shaft, for example. The motor 42 is operatively joined to the controller 38 illustrated in FIG. 1 and is periodically operated to rotate the belt ice tray around the two rollers.

In this way, several row s of the ice molds 26 are located on the top of the belt facing upwardly for containing the water and corresponding ice cubes therein. And, more rows of the ice molds are disposed on the bottom of the belt facing downwardly and being inverted and empty. As the ice is produced in the top row of molds and periodically transported to the right in FIG. 1, row-by-row of the ice cubes are dumped into the hopper as the corresponding ice molds are turned upside down as they travel around th e idler roller. In this way, the rollers 40 and motor 42 cooperate with the belt form of the ice tray for conveniently dumping the ice cubes from the rows of ice molds as they travel around the idler roller.

As shown in FIG. 1, the controller 38 is operatively joined to the compressor 20*a*, the motor 42, and the water nozzle 34 through its controlling solenoid valve. In this way, the one controller 38 may control all of the functions of the refrigerator in an integrated manner.

In initial operation of the icemaker, the motor 42 is periodically driven to position each of the top rows of ice molds below the water nozzle 34 for receiving water therefrom. In this way, all of the upward ice molds may be suitably filled with water for being frozen inside the freezer compartment. The temperature sensor 36 measures the temperature inside the freezer compartment which is integrated over time until the monitoring parameter matches the predetermined freezing standard indicating transformation of the water into the ice cubes 30.

The controller 38 then activates the motor 42 for rotating the belt tray row-by-row for dumping a row of ice cubes from the distal end row of ice molds adjacent the hopper 32, and correspondingly activating the water nozzle 34 to fill the proximal or forward row of ice molds at the opposite end of the belt tray which row is initially empty from its travel at the bottom of the belt.

In steady state operation, the belt is preferably indexed row-by-row dumping the end row of ice cubes and filling with water the forward row of ice molds. Correspondingly, the intermediate rows of ice molds bet ween the forward and aft rows will have varying amounts of water-to-ice transformation depending upon the amount of time each row of water is maintained inside th e freezer.

Accordingly, the controller 38 is further configured for integrating separately the measured temperature over time for each of the ice mold rows between the forward and aft end rows. This may be conveniently effected in software by assigning a position number for each of the several rows at the top of the belt and monitoring the position thereof from the forward end in which they first receive water to their terminal position at the aft end of the belt from which the ice cubes are dumped.

FIG. 2 illustrates schematically the corresponding monitoring parameter in degree-minutes for each of the several rows of ice molds between the two rollers 40 which increases in magnitude from the forward to aft end rows.

The integration over time of below-freezing exposure of the water in each of the rows is re-initialized or starts anew at the forward row position in which water is received from the nozzle. The magnitude of the monitoring parameter for each row increases as each of the rows travels to the right in FIG. 2 to a maximum value at the aft end row at the time of dumping of the formed ice cubes.

The rate of production of ice cubes may be maximized by controlling the speed of rotation of the ice belt so that the water in the rows thereof completely freezes just prior to the aft row position. In this way, the rows of water travel with the belt and decrease in temperature to below freezing over the length of travel of the top half of the belt. The controller 38 may also be configured for actively controlling the rate of travel of the ice belt based on the integration of temperature measured by the sensor 36 to ensure that the ice cubes 30 are sufficiently formed just prior to dumping from the belt into the hopper.

A particular advantage of the ice detection system is that only a single temperature sensor 36 is required for detecting ice transformation in each of the several traveling rows of ice molds, as well as being useful for controlling the refrigeration system 20 if desired. Since it is impractical to mount individual pressure sensors in each of the several rows of the ice belt for detecting temperature therein, the single temperature sensor 36 substantially reduces complexity of the system and permits integration of the below freezing temperature experienced for each row of the ice belt.

Since the one temperature sensor 36 may accurately measure temperature in the freezer compartment, that same temperature may be used in the controller 38 for controlling operation of the compressor 20*a* and the resulting temperature inside the freezer. The compressor may be cycled on when the measured temperature inside the freezer reaches a preferred maximum temperature of about 15 degrees F. for example, and cycles off when the temperature inside the freezer reaches a suitable minimum such as about 5 degrees F. for example.

The versatility of the microprocessor controller 38 permits indirect detection of the water-to-ice transformation inside the ice molds of the traveling belt. By monitoring the degree-minutes below freezing temperature experienced by each of the several rows of ice molds, corresponding monitoring parameters may be tracked therefor and separately compared to the freezing standard.

Upon the accumulation of a sufficient magnitude of degree-minutes below freezing temperature associated with the freezing standard, the water and the corresponding ice mold row is sufficiently transformed into ice for then being dumped into the hopper. The belt is indexed, a new row of ice molds is filled with water, and the monitoring parameter is updated for each row in turn as the water is cooled and frozen therein.

Although the ice tray 24 in the form of the continuous belt is preferred in the exemplary embodiment disclosed above, any form of ice tray may be used with temperature monitoring thereof in accordance with the present invention. A conventional stationary ice tray used in automatic icemakers permits freezing of the water in all of the compartments thereof prior to being dumped by corresponding rotating forks or tines. A temperature sensor disposed in the freezer compartment may be used in such embodiment in cooperation with a controller for integrating over time the below freezing temperature experienced by the water after introduction into the ice tray. After a sufficient time and accumulation of sufficient degree-minutes, the ice in the tray is ready for harvesting which may be effected in any conventional manner.

Accordingly, below freezing temperature integration over time may be effected with the inherent programming capabilities of a microprocessor controller and the use of a single temperature sensor suitably located in the freezer compartment. Direct temperature measurement of the water in the individual ice tray compartments is not required, and the associated complexity thereof may be eliminated for reducing the cost of the ice making system, as well as reducing overall cost of the refrigerator in a competitive market.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured Letters Patent of the United States is the invention as defined and differentiated in the following claims in which we claim:

1. A method for detecting ice transformation in an icemaker tray comprising:

filling said tray with water;

exposing said water in said tray to freezing temperature;

measuring said freezing temperature; integrating said measured temperature over time commencing with filling said tray with said water to obtain a monitoring parameter; and comparing said monitoring parameter with a predetermined freezing standard for detecting transformation of said water into ice.

2. A method according to claim 1 further comprising measuring said freezing temperature remote from said ice tray.

3. A method according to claim 2 further comprising periodically comparing said monitoring parameter with said freezing standard until matching thereof, and then dumping from said tray ice transformed from said water therein.

4. A method according to claim 2 wherein said ice tray comprises a belt having rows of ice molds therein, and further comprising integrating said measured temperature over time separately for each of said rows filled with water.

5. A method according to claim 4 further comprising:

periodically rotating said belt tray for dumping ice formed in an end row of said ice molds;

filling with water a forward row of said ice molds disposed at an opposite end of said belt tray; and integrating separately said measured temperature over time for each of said ice mold rows between said forward and end rows.

6. A method according to claim 5 further comprising controlling said freezing temperature in response to said measured temperature used in integration thereof over time.

7. A method for detecting ice transformation in an ice tray belt having rows of ice molds therein comprising:

filling with water said rows of said ice molds from forward to end rows thereof at opposite ends of said ice tray belt;

exposing said water in said ice tray rows to freezing temperature;

measuring said freezing temperature:

integrating said measured temperature over time separately for each of said rows commencing with filling thereof with water to obtain corresponding monitoring parameters for each of said rows; and comparing said monitoring parameters with a predetermined freezing standard for detecting transformation of said water into ice for each of said rows.

8. A method according to claim 7 further comprising periodically comparing said monitoring parameter for said end row with said freezing standard until matching thereof, and then dumping from said end row ice transformed from said water therein.

9. A method according to claim 8 further comprising:

periodically rotating said belt tray for dumping ice formed in said end row;

filling with water said forward row of ice molds disposed at said opposite end of said belt tray; and integrating separately said measured temperature over time for each of said ice mold rows between said forward and end rows.

10. A method according to claim 9 further comprising measuring said freezing temperature remote from said ice tray belt.

11. A method according to claim 9 further comprising controlling said freezing temperature in response to said measured temperature used in integration thereof over time.

12. An icemaker comprising:

an ice tray;

means for filling said tray with water;

a refrigeration system for exposing said water in said tray to freezing temperature;

a temperature sensor for measuring said freezing temperature;

a controller configured for integrating said measured temperature over time commencing with filling said tray with said water to obtain a monitoring parameter; and said controller being further configured for comparing said monitoring parameter with a predetermined freezing standard for detecting transformation of said water into ice.

13. An icemaker according to claim 12 wherein said temperature sensor is positioned remote from said ice tray.

14. An icemaker according to claim 13 wherein said controller is further configured for periodically comparing said monitoring parameter with said freezing standard until matching thereof; and further comprising means for dumping from said tray ice transformed from said water therein.

15. An icemaker according to claim 13 wherein:

said ice tray comprises a belt having rows of ice molds therein; and said controller is further configured for integrating said measured temperature over time separately for each of said rows filled with water.

16. An icemaker according to claim 15 further comprising a motor operatively joined to said belt tray and controller, and wherein:

said filling means are operatively joined to said controller;

said controller is further configured for periodically rotating said belt tray for dumping ice formed in an end row of said ice molds, and filling with water a forward row of said ice molds disposed at an opposite end of said belt tray; and said controller is further configured for integrating separately said measured temperature over time for each of said ice mold rows between said forward and end rows.

17. An icemaker according to claim 16 wherein said controller is operatively joined to said refrigeration system for controlling said freezing temperature therefrom in response to said measured temperature from said temperature sensor used in integration over time.

18. An icemaker according to claim 17 further comprising a single temperature sensor for controlling both said refrigeration system and said ice transformation monitoring.

* * * * *

UNITED STATES PATENT AND TRADEMARK OFFICE

CERTIFICATE OF CORRECTION

PATENT NO. : 6,349,550 B1
DATED : February 26, 2002
INVENTOR(S) : Shapiro et al.

It is certified that error appears in the above-identified patent and that said Letters Patent is hereby corrected as shown below:

Title page,
Item [56], References Cited, U.S. PATENT DOCUMENTS, insert the following:
-- 3,952,539 A 4/1976 Hanson et al. --; and insert:
-- OTHER PUBLICATIONS
"Understanding Commercial Ice Makers," Parker, 1988, pp. 29, 47.
Shapiro et al., Patent Application SN 09/617,935, August 17, 2000. --

Signed and Sealed this

Eighteenth Day of May, 2004

JON W. DUDAS
*Acting Director of the United States Patent and Trademark Office*